US006100637A

United States Patent [19]

Kishino et al.

[11] Patent Number: 6,100,637

[45] Date of Patent: Aug. 8, 2000

[54] FIELD EMISSION DISPLAY (FED) WITH MATRIX DRIVING, ELECTRON BEAM FOCUSING AND GROUPS OF STRIP-LIKE ELECTRODES USED FOR THE GATE AND ANODE

[75] Inventors: Takao Kishino; Yoichi Kobori; Shigeo Itoh; Takahiro Niiyama; Toshimitsu Fuyuki; Koji Onodaka, all of Mobara, Japan

[73] Assignee: Futaba Denshi Kogyo K.K., Mobara, Japan

[21] Appl. No.: 09/066,771

[22] Filed: Apr. 27, 1998

Related U.S. Application Data

[63] Continuation of application No. 08/315,578, Sep. 30, 1994, Pat. No. 5,786,795.

[30] Foreign Application Priority Data

Sep. 30, 1993 [JP] Japan ..... 5-245193
Oct. 20, 1993 [JP] Japan ..... 5-262388

[51] Int. Cl.[7] ..... H01J 1/62; H01J 1/02; H01J 1/16

[52] U.S. Cl. ..... 313/495; 313/336; 313/351; 315/169.1; 315/169.3

[58] Field of Search ..... 313/495, 309, 313/336, 351, 310; 445/24, 50; 315/169.3, 169.1

[56] References Cited

U.S. PATENT DOCUMENTS 4,857,799 8/1989 Spindt et al. ..... 313/495
5,186,670 2/1993 Doan et al. ..... 445/24

*Primary Examiner*—Nimeshkumar D. Patel
*Assistant Examiner*—Joseph Williams
*Attorney, Agent, or Firm*—Oblon, Spivak, McClelland, Maier & Neustadt, P.C.

[57] ABSTRACT

A field emission type fluorescent display device capable of exhibiting high luminescence under a low voltage while minimizing leakage luminescence and color mixing, to thereby improve display quality. An anode and a field emission cathode are arranged opposite to each other and the cathode is divided into a plurality of unit regions in a matrix-like configuration, which are matrix-driven, resulting in a display being selectively carried out. The unit regions each are divided into a plurality of subregions and the cathode and anode are divided into a plurality of strip-like electrodes perpendicular to each other, respectively. The strip-like electrode each correspond to each of subregions and are commonly connected to each other at every second interval. Also, a focusing electrode may be arranged between the gate and the anode so as to surround the unit regions.

2 Claims, 15 Drawing Sheets

FIELD EMISSION DISPLAY (FED) WITH MATRIX DRIVING, ELECTRON BEAM FOCUSING AND GROUPS OF STRIP-LIKE ELECTRODES USED FOR THE GATE AND ANODE

This application is a Continuation of application Ser. No. 08/315,578, filed on Sep. 30, 1994, Pat. No. 5,786,795.

BACKGROUND OF THE INVENTION

This invention relates to a field emission type fluorescent display device and a method for driving the same, and more particularly to an improvement in a field emission type fluorescent display device wherein an electron emission region of a field emission cathode is divided into a plurality of unit regions for matrix driving, to thereby permit an anode facing the field emission cathode to carry out a graphic display and a method for driving the same.

Now, a conventional field emission type fluorescent display device will be described with reference to FIGS. 17 and 18, wherein FIG. 17 generally shows a conventional fluorescent display device and FIG. 18 electronically analytically shows the fluorescent display device. The conventional flied emission type fluorescent display device, as shown in FIG. 17, generally includes a field emission cathode 103 including a cathode conductor 100, emitters 101 and a gate 102, and an anode 104 having a phosphor arranged in a manner to face the field emission cathode. The anode 104 and gate 102 each constitute an individual electrode and have a positive bias voltage applied thereto. Also, the cathode conductor 100 is divided into a plurality of unit regions 105 so as to correspond to unit luminous regions of the anode 104. The unit regions 105 are arranged in a matrix-like manner and connected to thin film transistors 106 for driving, respectively, resulting in being matrix-driven.

The conventional field emission type fluorescent display device thus constructed, as described above, is so constructed that the anode 104 and gate 102 constitute individual electrodes, respectively, and are arranged so as to face each other. Also, the anode 104 And gate 102 each have a positive bias voltage constantly applied thereto. For example, the anode 104 has a positive voltage of 100 V applied thereto and the gate 102 has a positive voltage of 400 V applied thereto, so that electron beans emitted from each of the unit regions 105 of the cathode conductor 100 are substantially diffused as shown in FIG. 18, resulting in a failure in a high-density display by fine luminous dots because of failing to provide a gap between the dots sufficient to prevent leakage luminescence. Also, this leads to another disadvantage of causing excitation of luminous dots of which luminescence is not desired.

SUMMARY OF THE INVENTION

The present invention has been made in view of the foregoing disadvantage of the prior art.

Accordingly, it is an object of the present invention to provide a field emission type fluorescent display device which is capable of minimizing diffusion or spreading of electrons emitted, to thereby minimize leakage luminescence, resulting in providing a high-definition display.

It is another object of the present invention to provide a method for driving a field emission type fluorescent display device which is capable of minimizing diffusion of electrons emitted, to thereby minimize leakage luminescence, leading to a high-definition display.

In accordance with one aspect of the present invention, a field emission type fluorescent display device is provided. The field emission type fluorescent display device includes a field emission cathode including a cathode conductor, emitters and a gate, and a phosphor-deposited anode arranged in a manner to be opposite to the field emission cathode. The field emission cathode has an electron emission region divided into a plurality of unit regions arranged in a matrix-like configuration. The unit regions are subject to matrix driving, resulting in a display being selectively carried out. The unit regions each are divided into a plurality of subregions. At least one of the gate and anode is divided into a plurality of strip-like electrodes, which are arranged in a manner to correspond to the subregions and commonly connected to each other at every second or more interval, to thereby provide a plurality of strip-like electrode groups.

In a preferred embodiment of the present invention, the gate comprises a plurality of strip-like electrode groups and the anode comprises a plurality of strip-like electrode groups, wherein the strip-like electrode groups of the gate and the strip-like electrode groups of the anode are arranged in a manner to be perpendicular to each other.

In accordance with a second aspect of the present invention, a method is provided for driving a field emission type fluorescent display device including a field emission cathode including a cathode conductor, emitters and a gate, and a phosphor-deposited anode arranged in a manner to be opposite to the field emission cathode, wherein the field emission cathode has an electron emission region divided into a plurality of unit regions arranged in a matrix-like configuration, the unit regions are subject to matrix driving, resulting in a display being selectively carried out, the unit regions each are divided into a plurality of subregions, at least one of the gate and anode is divided into a plurality of strip-like electrodes, and the strip-like electrodes are arranged in a manner to correspond to the subregions and commonly connected to each other at second or more interval, to thereby provide a plurality of strip-like electrode groups. The method comprises the steps of subjecting the cathode conductor to active matrix driving and feeding a driving signal to the plurality of strip-like electrodes in turn, whereby the subregions of each of the unit regions are repeatedly driven in turn.

In the present invention constructed as described above, the cathode conductor is subject to active matrix driving and the strip-like electrode groups of each of the anode and gate are fed with a driving signal in turn, so that only the subregions of the cathode conductor selected by the gate and anode successively emit electrons in time with driving of the strip-like electrodes. The electrons thus emitted are focused by an electric field generated between the strip-like electrodes selected and the strip-like electrodes kept at a off-level, to thereby reach the anode, resulting in a desired luminous display. Such construction prevents subregions adjacent to the selected subregions from emitting electrons concurrently with the selected ones, to thereby substantially prevent leakage luminescence.

In accordance with the first aspect of the present invention, a field emission type fluorescent display device is also provided. The device includes a field emission cathode including a cathode conductor, emitters and a gate, and a phosphor-deposited anode arranged in a manner to be opposite to the field emission cathode. The field emission cathode has an electron emission region divided into a plurality of unit regions arranged in a matrix-like configuration. The unit regions are subject to matrix driving, resulting in a display being selectively carried out. The device also includes a focusing electrode arranged between the gate and the anode for surrounding the unit regions.

In the field emission fluorescent display device thus constructed, matrix driving of the unit regions of the cathode conductor permits electrons to be emitted from the unit regions selected, which are then focused by the focusing electrode surrounding the unit regions and then travel to the anode, leading to a desired luminous display. Thus, only the luminous regions of the anode selected contribute to luminescence, resulting in leakage luminescence from the non-selected luminous regions being effectively prevented.

In a preferred embodiment of the present invention, the focusing electrode is fed with a voltage lover than that fed to the gate.

In a preferred embodiment of the present invention, the focusing electrode is integrally formed.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
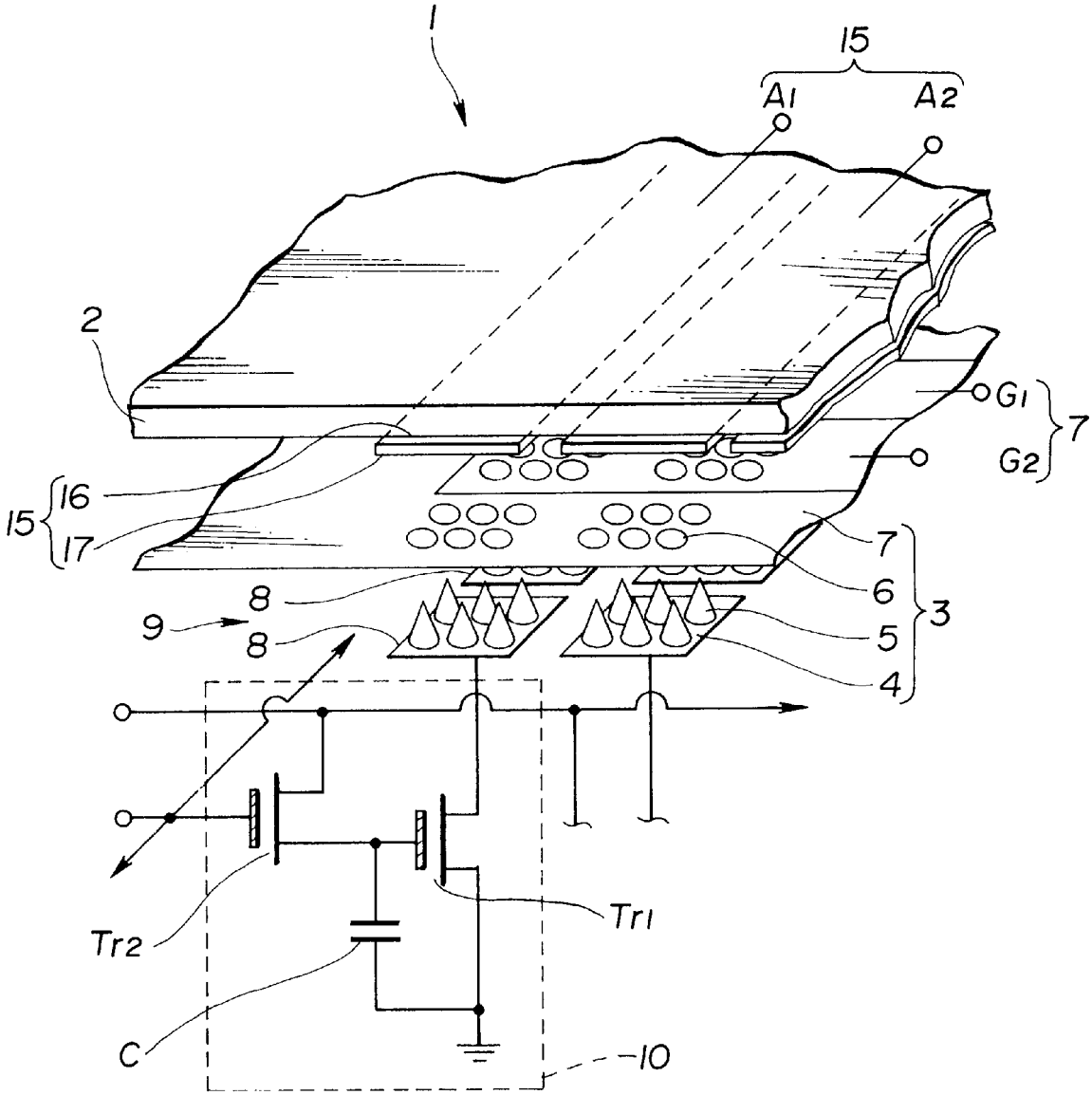
FIG. 1 is a fragmentary perspective view schematically showing an embodiment of a field emission type fluorescent display device according to the present invention.

Now, the present invention will be described hereinafter with reference to FIGS. 1 to 16.

Referring first to FIGS. 1 to 13, a first embodiment of a field emission type fluorescent display device according to the present invention is illustrated. A field emission type fluorescent display device (hereinafter also referred merely to as "fluorescent display device") of the illustrated embodiment generally designated at reference numeral 1 includes a light-permeable anode substrate 2 and a cathode substrate (not shown) arranged in a manner to be opposite to the anode substrate 2 while being spaced at a predetermined interval from the anode substrate 2. The anode substrate 2 and cathode substrate are sealedly joined to each other through spacer members interposed therebetween, resulting in providing an envelope, which is then evacuated to a high vacuum.

The cathode substrate is formed on an inner surface thereof with a field emission cathode (FEC) 3, which includes a cathode conductor 4 made of a high-melting metal material such as Nb, Ta, Mo or the like, emitters 5 provided on the cathode conductor 4 and a gate 7 arranged above the emitters 5 and formed with apertures 6 in a manner to positionally correspond to the emitters 5.

The cathode conductor 4 in divided into a plurality of unit regions 9 each provided with thereon a plurality of emitters 5. In the illustrated embodiment, six such emitters 5 are arranged on each of the unit regions 9. The unit regions 9 comprise a plurality of groups of four-in-one-set subregions 8 each defined by cooperation between each adjacent two strip-like electrodes of the gate 7 and each adjacent two strip-like electrodes of an anode, which will be described hereinafter. The thus-defined subregions 8 are arranged in rows in both row and column directions, to thereby form a matrix.

Each groups of the four-in-one-set subregions 8 includes a driving transistor section 10 acting as a driving section. The driving transistor sections 10 each comprise two transistors Tr1 and Tr2 and a capacitor C. The four-in-one-set subregions 8 cooperate with the corresponding drive transistor sections 10 to form the unit regions 9, respectively, resulting in providing the field emission cathode 3, which is then integrally mounted on the cathode substrate.

The transistors Tr2 of the driving transistor sections likewise arranged in a matrix-like manner are connected at a gate electrode thereof to each other for every column of the matrix and at a drain electrode thereof to each other for every row thereof. Rows Yl to Ym of the matrix constituted by a plurality of the drive transistor sections 10 are connected to a main-scan side shift register 21 and columns Xl to Xn thereof are connected to a sub-can side shift register 22, so that image data may be fed from a side of the rows Xl to Xn through a driver to the drive transistor sections 10.

Figure 2:
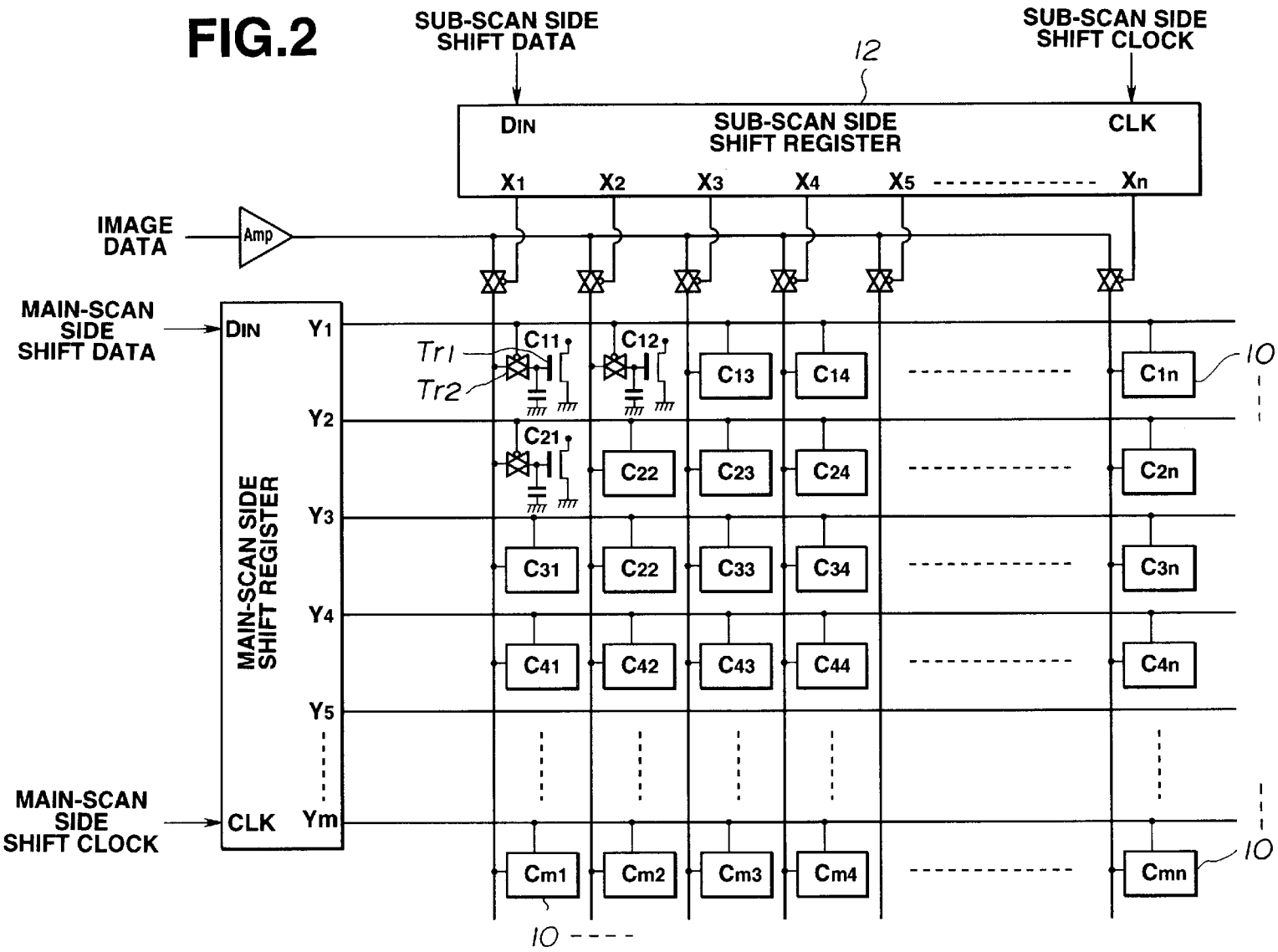
FIG. 2 is a circuit connection diagram shoving an example of a cathode driving circuit in the field emission type fluorescent display device of FIG. 1.
Figure 3:
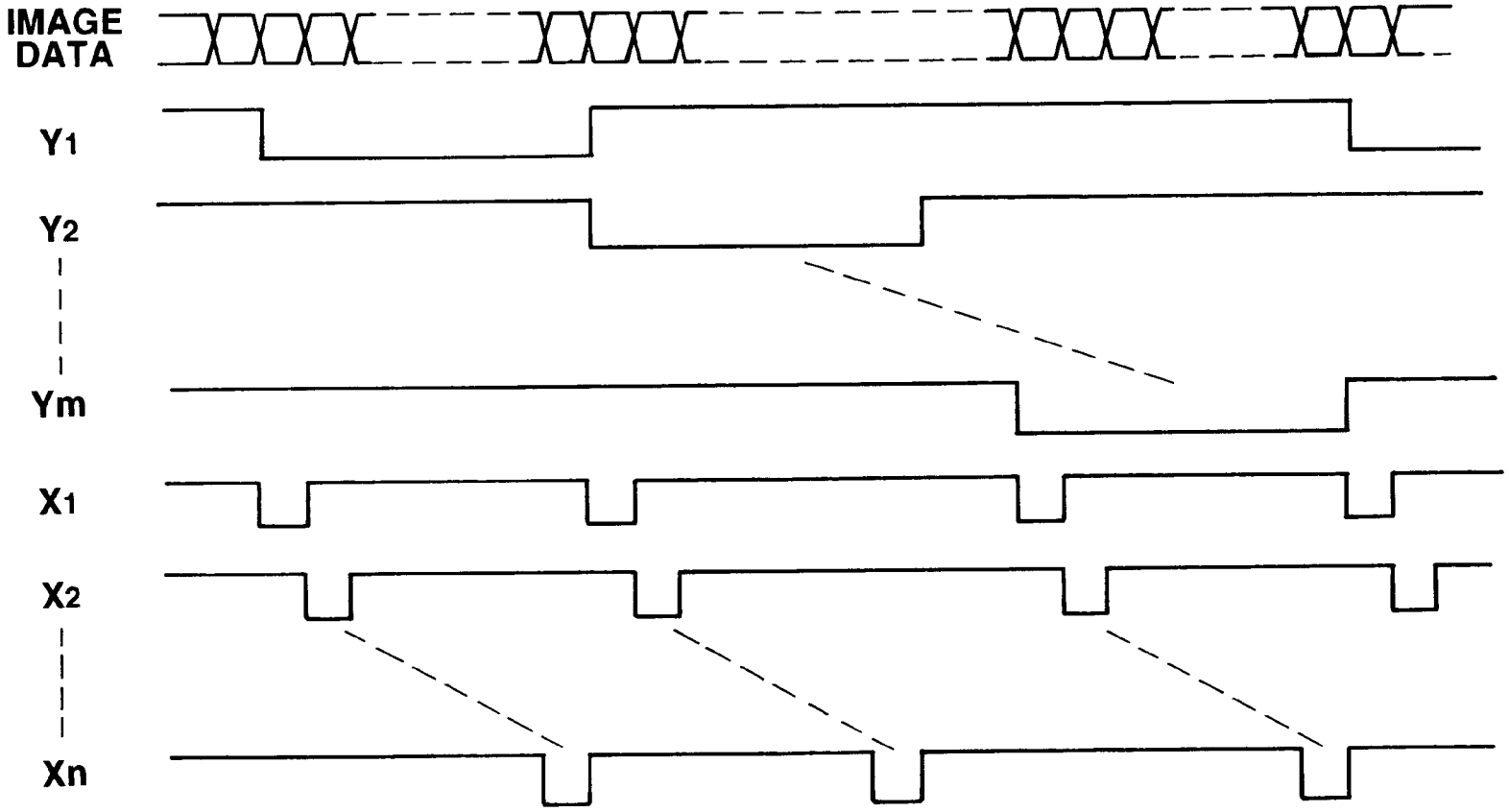
FIG. 3 is a timing chart showing a driving timing of a field emission cathode in the field emission type fluorescent display device of FIG. 1.

In the above-described matrix construction of the first embodiment, as will be noted from FIGS. 2 and 3, the main-scan side shift register 21 subjects the rows Yl to Ym of the matrix to main scanning in turn and the sub-scan side shift register 22 subjects the the columns Xl to Xn to subscanning in turn in time with selection of each of the rows, so that the capacitors C of the drive transistor sections 10 selected by control scanning thus carried out are charged with image data.

Figure 4:
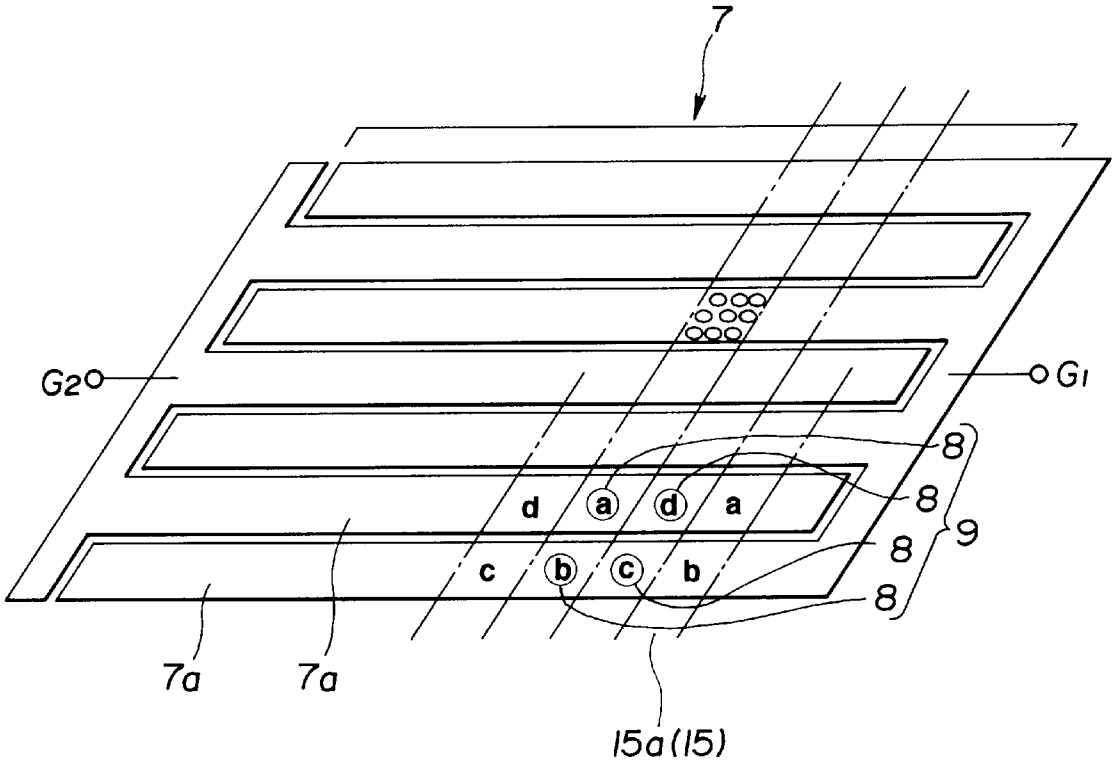
FIG. 4 is a perspective view schematically showing strip-like electrode groups of a gate in the field emission type fluorescent display of FIG. 1.

The gate 7 of the field emission cathode 3, as shown in FIGS. 1 and 4, is divided into a plurality of strip-like electrodes 7*a*, which are arranged so as to extend in parallel with with each other in a direction of the row of the matrix. In FIGS. 1 and 4, only two strip-like electrodes 7*a* are shown for the sake of brevity. The strip-like electrodes 7*a* of the gate 7, as shown in FIG. 4, each are formed into a width corresponding to each groups of four-in-one-set subregions 8. Also, the strip-like electrodes 7*a* are alternately commonly connected to each other for every second interval, resulting in forming, as a whole, two groups of strip-like electrode groups G1 and G2 extending in the direction of the row of the matrix.

The anode substrate 2, as shown in FIG. 1, is formed on an inner surface thereof with an anode 15 acting as a luminous display section. The anode 15 is constituted by a light-permeable anode conductor 16 and a phosphor layer 17 deposited on the anode conductor 16. Light emitted from the phosphor layer 17 can be externally observed through the light-permeable anode conductor 16 and anode substrate 2.

Figure 5:
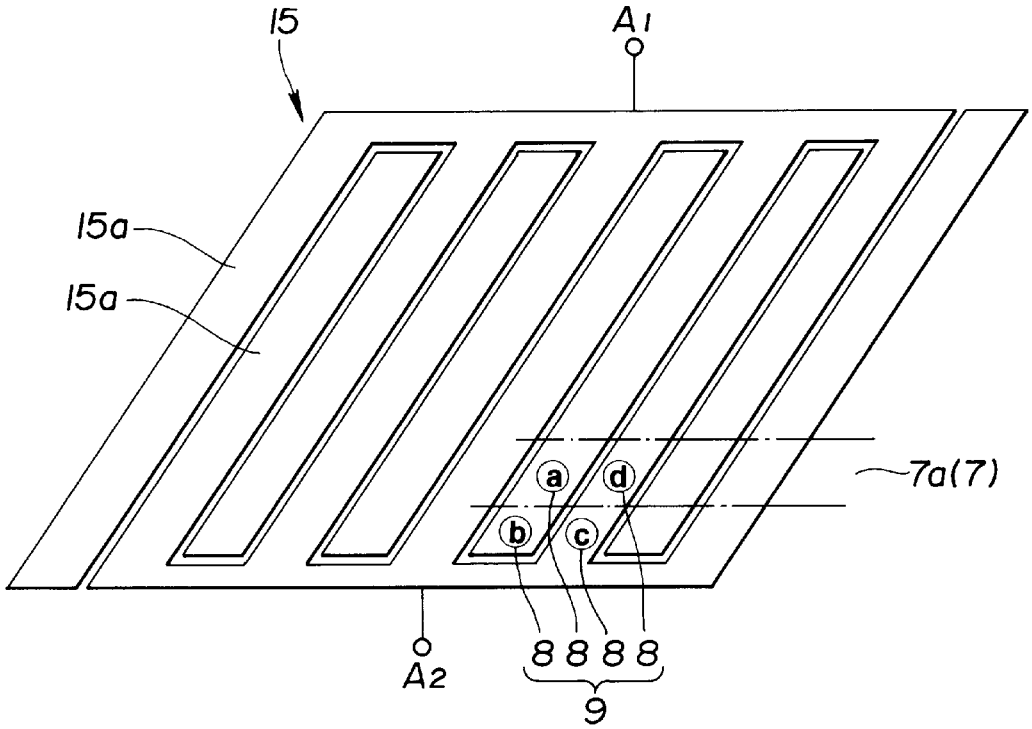
FIG. 5 is a perspective view schematically showing strip-like electrode groups of an anode in the field emission type fluorescent display device of FIG. 1.

The anode 15 formed on the anode substrate 2, as shown in FIGS. 1 and 5, is divided into a plurality of strip-like electrodes 15*a*, which are arranged so as to be adjacent to each other. In FIGS. 1 and 5, only two such strip-like electrodes 15*a* are shown for the sake of brevity. The strip-like electrodes 15*a* of the anode 15 are arranged so as to extend in parallel with each other in a direction of the column of the matrix and each are formed into a width corresponding to each four-in-one-set subregions 8, as shown in FIG. 5. Also, the strip-like electrodes 15*a* of the anode 15 are alternately commonly connected to each other for every second interval, resulting in constituting two strip-like electrode groups A1 and A2.

Figure 6:
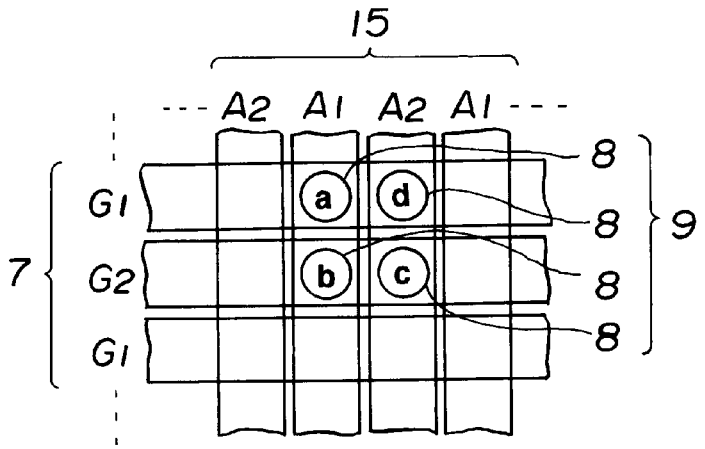
FIG. 6 is a fragmentary schematic plan view showing a manner of intersection between strip-like electrode groups of a gate and those of an anode in the field emission type fluorescent display device of FIG. 1.
Figure 7:
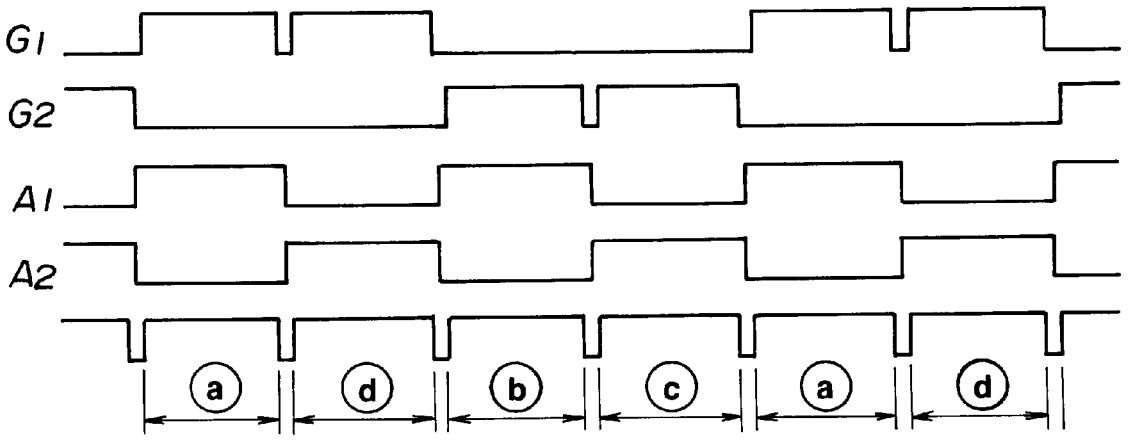
FIG. 7 is a timing chart showing a driving timing of strip-like electrode groups of a gate and strip-like electrode groups of an anode in the field emission type fluorescent display device of FIG. 1.

Each adjacent two of the strip-like electrode groups G1 and G2 of the gate 7 extending in the row direction of the matrix and each adjacent two of the strip-like electrode groups A1 and A2 of the anode 15 extending in the column direction thereof which are arranged so as to be perpendicular to each other cooperate with each other to define each groups of four regions a, b, c and d in correspondence to each four groups of four-in-one-set subregions 8 and in a manner to be adjacent to each other in both row and column directions of the matrix, as shown in FIG. 6. The strip-like electrode groups G1 and G2 of the gate 7 and the strip-like electrode groups A1 and A2 of the anode 15, as shown in FIG. 7, permit the regions a, b, c and d in plural groups to be selectively driven in a predetermined order and an output enable signal is defined so as to set fine non-selection terms between selection terms of the regions a to d, to thereby prevent the regions from being selected while overlapping with each other.

Figure 8:
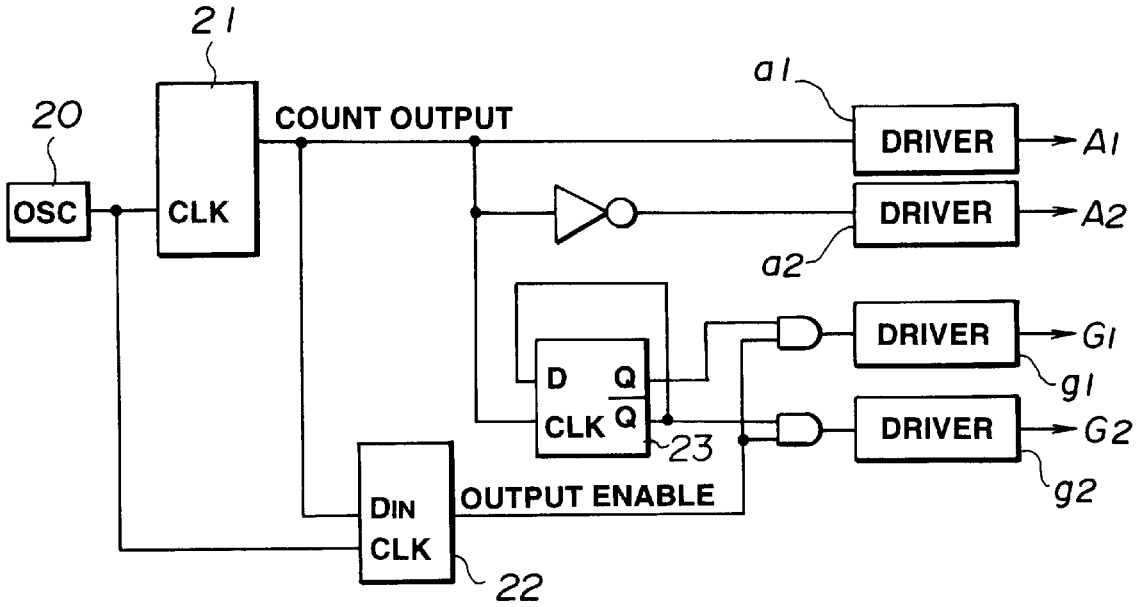
FIG. 8 is a circuit connection diagram showing an example of a driving circuit for strip-like electrode groups of a gate and strip-like electrode groups of an anode in the field emission type fluorescent display device of FIG. 1.

Referring now to FIG. 8, an example of a circuit for realizing driving of the strip-like electrode groups G1 and G2 and strip-like electrode groups A1 and A2 is illustrated. In the driving circuit of FIG. 8, an oscillation section 20 generates an oscillation output, which is counted by a counter section 21.

Then, the counter section 21 outputs a counted value in the form of a reference signal. The reference signal is then fed to a driver $a_1$ in the column direction, to thereby drive one strip-like electrode group A1 in the column direction and an inversion signal of the reference signal is fed to a driver $a_2$ in the column direction, to thereby drive the other strip-like electrode group A2 in the column direction. Also, the oscillation output and reference signal are fed to a decoder latch section 22 to cause it to generate an output enable signal and the reference signal is fed to a flip-flop section 23 to cause two outputs mutually inverted to be generated. Then, two such inverted outputs and the output enable signal are input to AND elements and then outputs of the AND elements are fed to drivers $g_1$ and $g_2$ in the row direction, resulting in the strip-like electrode groups G1 and G2 being driven. Thus, the gate 7 and anode 15 constructed as described above permit the unit regions 9 to be circulatedly selected for every group of four regions a to d.

This results in the subregions 8 directly adjacent to the subregions selected being kept non-luminous. In connection with the subregions 8 selected, the gate 7 and anode 15 adjacent to the selected subregions 8 are perpendicular to each other and at a off-level so as to surround them, so that an electric field for converging or focusing electrons emitted, resulting in the emitted electrons impinging on only the corresponding portions of the anode 15 without diffusing, to thereby permit the portions to emit light. Thus, leakage luminescence is effectively prevented in even a fluorescent display device for high-definition display.

In the illustrated embodiment, all picture cells corresponding to the subregions 8 of the cathode is constantly subject to luminescence, therefore, it is not necessarily required to coincide a timing of transfer of image date to the drivers in the cathode driving circuit shown in FIG. 2 with the above-described timing of changing-over control (display timing control) of the gate 7 and anode 15.

Figure 9:
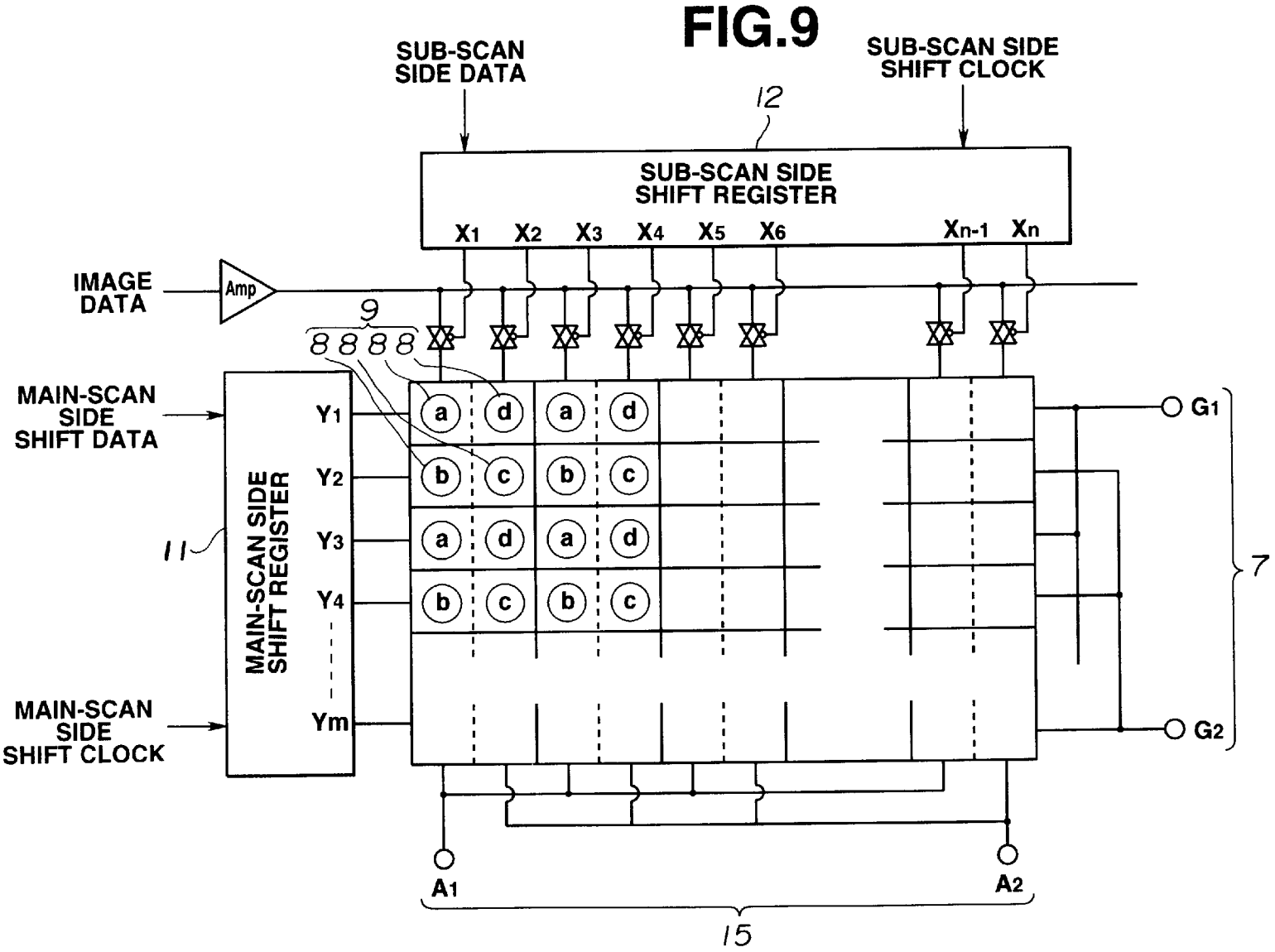
FIG. 9 is a diagrammatic view showing a relationship between a cathode driving circuit and subregions defined by cooperation of an anode and a gate in the field emission type fluorescent display device of FIG. 1.
Figure 10:
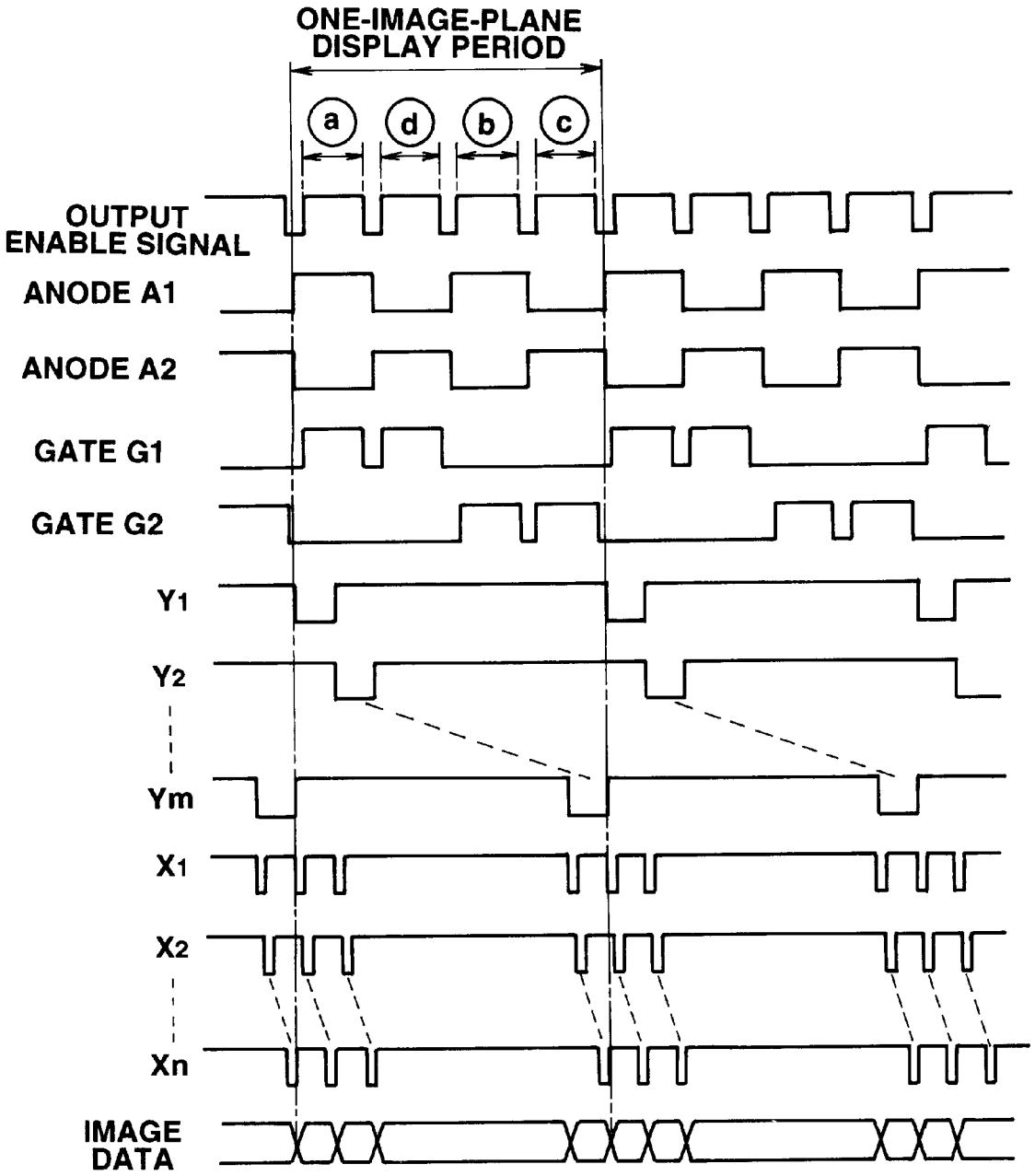
FIG. 10 is a timing chart showing a driving timing of the field emission type fluorescent display device of FIG. 1.

FIG. 9 shows a circuit wherein the gate 7 and anode 15 are arranged in a manner to correspond to the the cathode driving circuit of FIG. 2 and FIG. 10 shows coincidence between driving timings in the construction of FIG. 9.

As described above, in the cathode driving circuit, the main scanning is carried out in the row direction and the subscanning is carried out in the column direction. Also, transfer of the image data is carried out for every row after each of rows is completely scanned in the column direction. Such operation is repeated from the first row Yl to the last row Ym in turn, so that display data are transferred to all the driving transistor sections 10 including the capacitor C acting as a storage means. Then, the strip-like electrode groups A1 and A2 of the anode 15 and the strip-like electrode groups G1 and G2 of the gate 7 are changed over in turn to display one picture plane while scanning is carried out from the first row Yl to the last row Ym.

Figure 11:
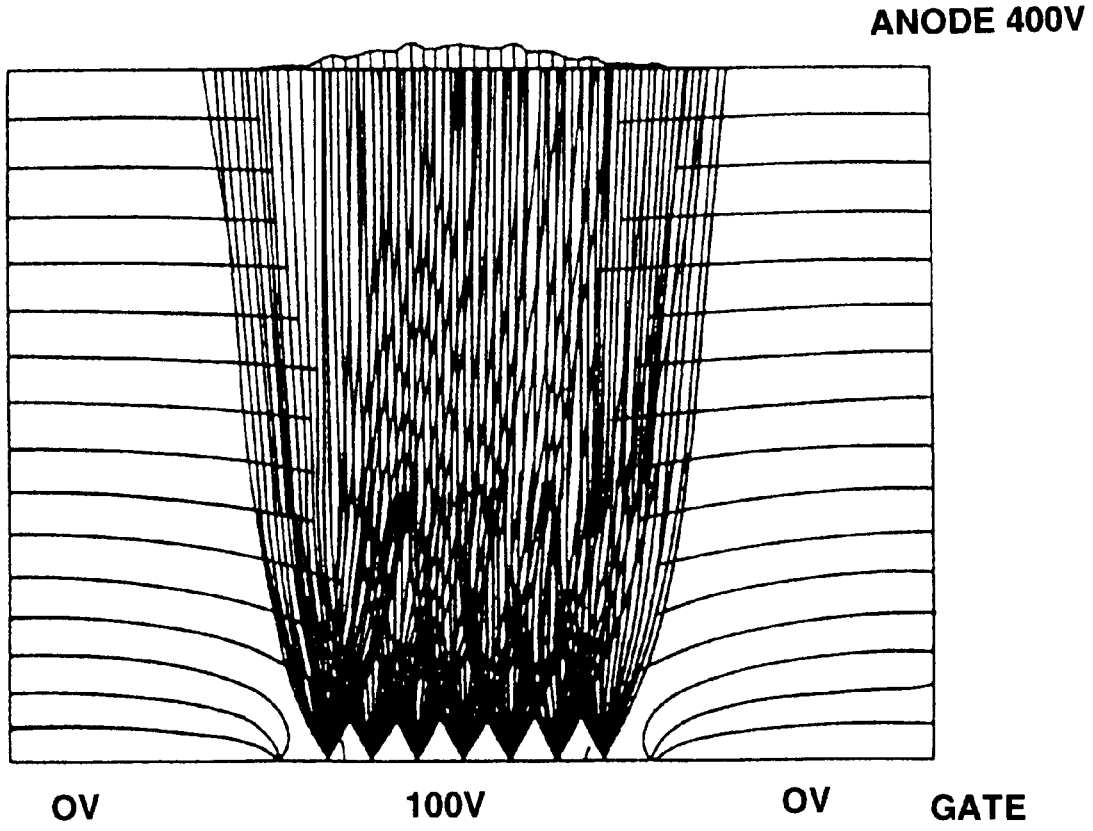
FIG. 11 is a view showing results of field analysis carried out along strip-like electrodes of an anode in the field emission type fluorescent display device of FIG. 1.

FIG. 11 shows results of computer simulation of field analysis carried out in a direction along the anode 15 in order to obtain a distribution of electrons during operation of the field emission type fluorescent display device of the illustrated embodiment. FIG. 11 clearly indicates that an electric field generated by reducing a potential of the adjacent strip-like electrodes of gate 7 to 0 V permits electron beams emitted to be effectively converged or focused, thus, it will be noted that leakage luminescence is prevented.

Figure 12:
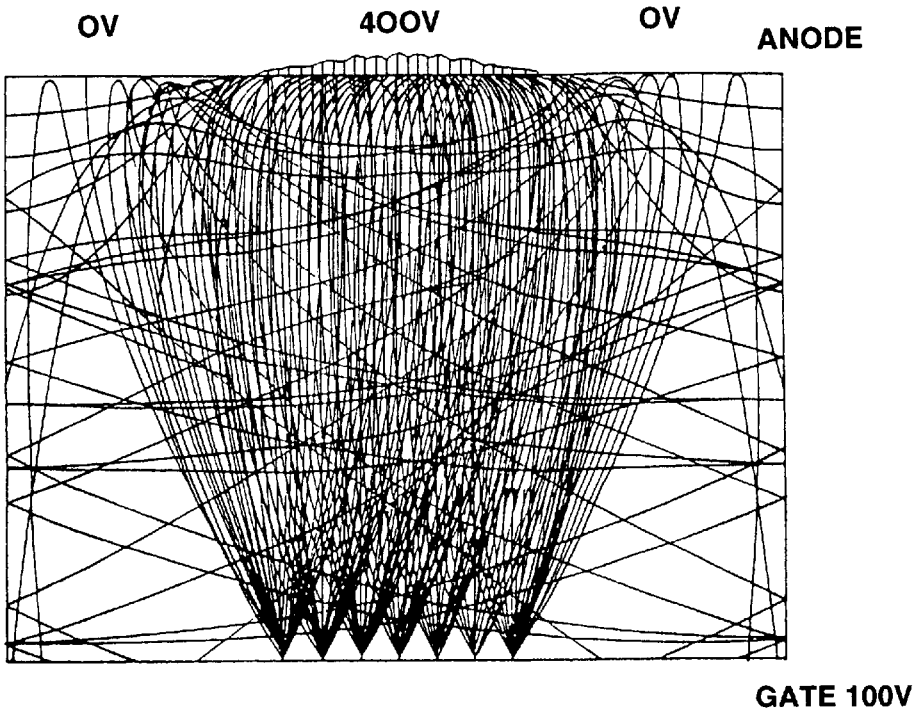
FIG. 12(A) is a view showing results of field analysis carried out along strip-like electrode of a gate in the field emission type fluorescent display device of FIG. 1.
FIG. 12(B) is a view showing results of field analysis carried out in a modification of the field emission type fluorescent display device of FIG. 1.
Figure 12:
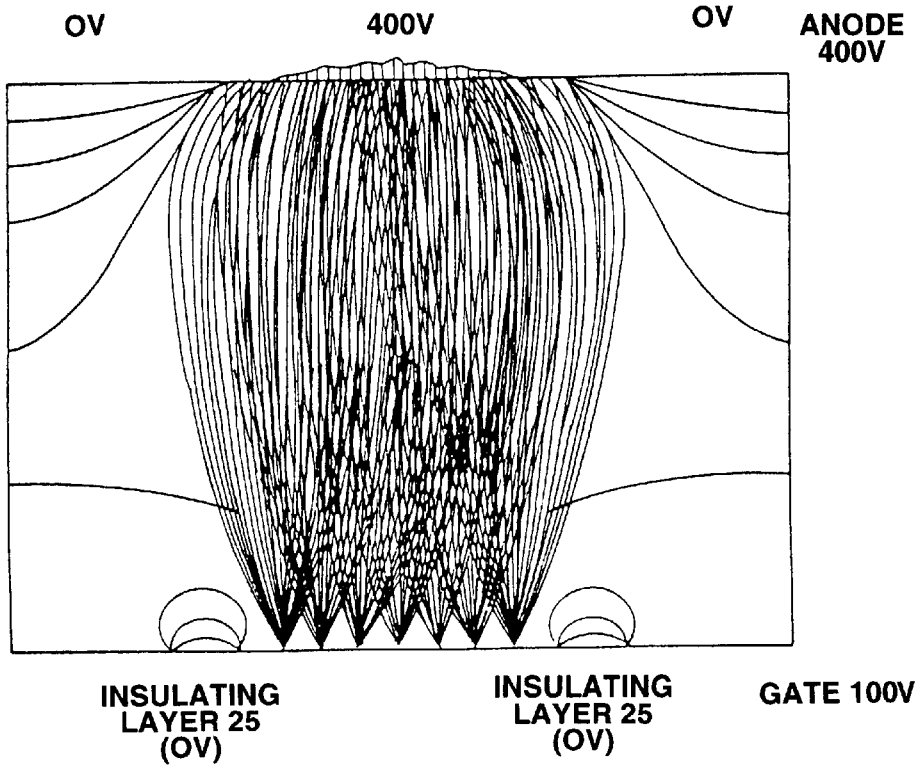

FIG. 12 (A) shows results of computer simulation of field analysis carried out in a direction perpendicular to that in FIG. 11 or a direction along the gate 7. FIG. 12(A) reveals that an electric field generated by reducing a potential of the adjacent anode 15 7 to 0 V permits electron beaus emitted to be effectively converged or focused, to thereby likewise prevent leakage luminescence, although it causes most of electrons repelled to flow into the gate, resulting in several percent of all electrons emitted forming a reactive current.

Figure 13:
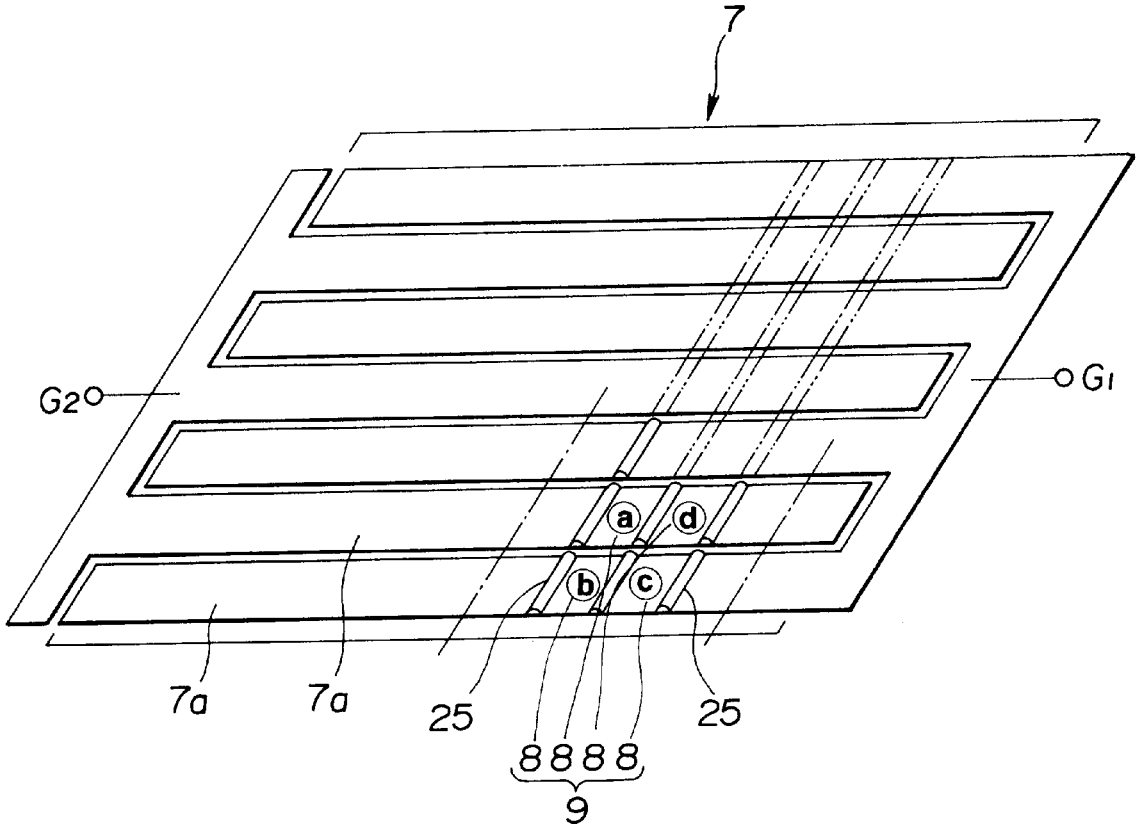
FIG. 13 is a perspective view schematically showing strip-like electrode groups of a gate provided with an insulating layer in the field emission type fluorescent display device of FIG. 1.

FIG. 12(B) shows that an electric field generated by charging-up of an insulating layer 25 which is provided on each of positions on the strip-like electrodes 7*a* of the gate 7 corresponding to both edges of the strip-like electrodes 15*a* of the anode 15 as shown in FIG. 13 permits electrons emitted to be more effectively converged. Thus, it will be noted that such construction ensures more effective focusing of electrons emitted to a degree sufficient to fully prevent leakage luminescence and substantially reduce such a reactive current described above.

In the first embodiment described above, the gate 7 and anode 15 are divided into the strip-like electrode groups G1 and G2 and strip-like electrode groups A1 and A2, respectively. Alternatively, any one of the gate 7 and anode 15 may be subject to such division as described above depending on density of luminous dots. Also, when the luminous dots are arranged with extensively high density, the gate 7 and anode 15 each may be divided into three or more groups. The same is true of the subregions 8 of each of the unit regions 9. Thus, for example, the first embodiment may be so constructed that only the anode 15 is divided into two strip-like electrode groups and the unit regions 9 each are divided into two subregions 8. Alternatively, it may be constructed in such a manner that the gate 7 and anode 15 each are divided into three strip-like electrode groups and the unit regions 9 each are divided into nine subregions 8. Each of such constructions likewise exhibits substantially the same function and advantage as described above.

In general, a fluorescent display device in which a field emission cathodes is subject to matrix driving by means of storage elements and transistors is generally featured in that a duty ratio is set to be at a level of 1/1 through operation of the storage elements. Such split driving as described above which is carried out in the first embodiment causes a duty ratio of the fluorescent display device to be reduced to a level of ½ to ¼, so that luminescence under the same driving voltage is decreased. However, in view of the fact that conventional simple matrix driving causes a duty ratio to be reduced to a level as low as 1/240 to 1/480, it will be understood that the duty ratio in the first embodiment is sufficiently increased as compared with the prior art. Also, the first embodiment permits a distribution of electrons emitted from the cathode to be controlled, leading to an improvement in display quality, resulting in serviceability thereof being substantially increased. The above-described decrease in luminescence in the device of the first embodiment can be readily eliminated by increasing a voltage input to the anode 15 by two to four times.

Thus, the field emission type fluorescent display device of the first embodiment exhibits a lot of significant advantages.

One of the advantages is that the first embodiment permits a field emission type fluorescent display device wherein a cathode conductor of a field emission cathode is subject to active matrix driving to be substantially decreased in leakage luminescence and color mixing, to thereby exhibit improved display quality while exhibiting an advantage such as an increase in luminance under a low voltage.

Another advantage is that a reactive current flowing to the gate and anode is minimized.

The field emission type fluorescent display device of first embodiment exhibits a further advantage of being simplified in structure to a degree sufficient to highly facilitate the manufacturing. For example, the anode and gate can be readily formed by etching or the like.

Still another advantage of the first embodiment is that it eliminates a necessity of arranging any additional electrode between the anode and the gate, resulting in the strip-like electrode groups of the anode and gate being arranged with highly increased density.

Further, the field emission type fluorescent display device of the first embodiment can be driven by simple operation which merely requires to select the strip-like electrode groups of the anode and/or gate in turn.

Figure 14:
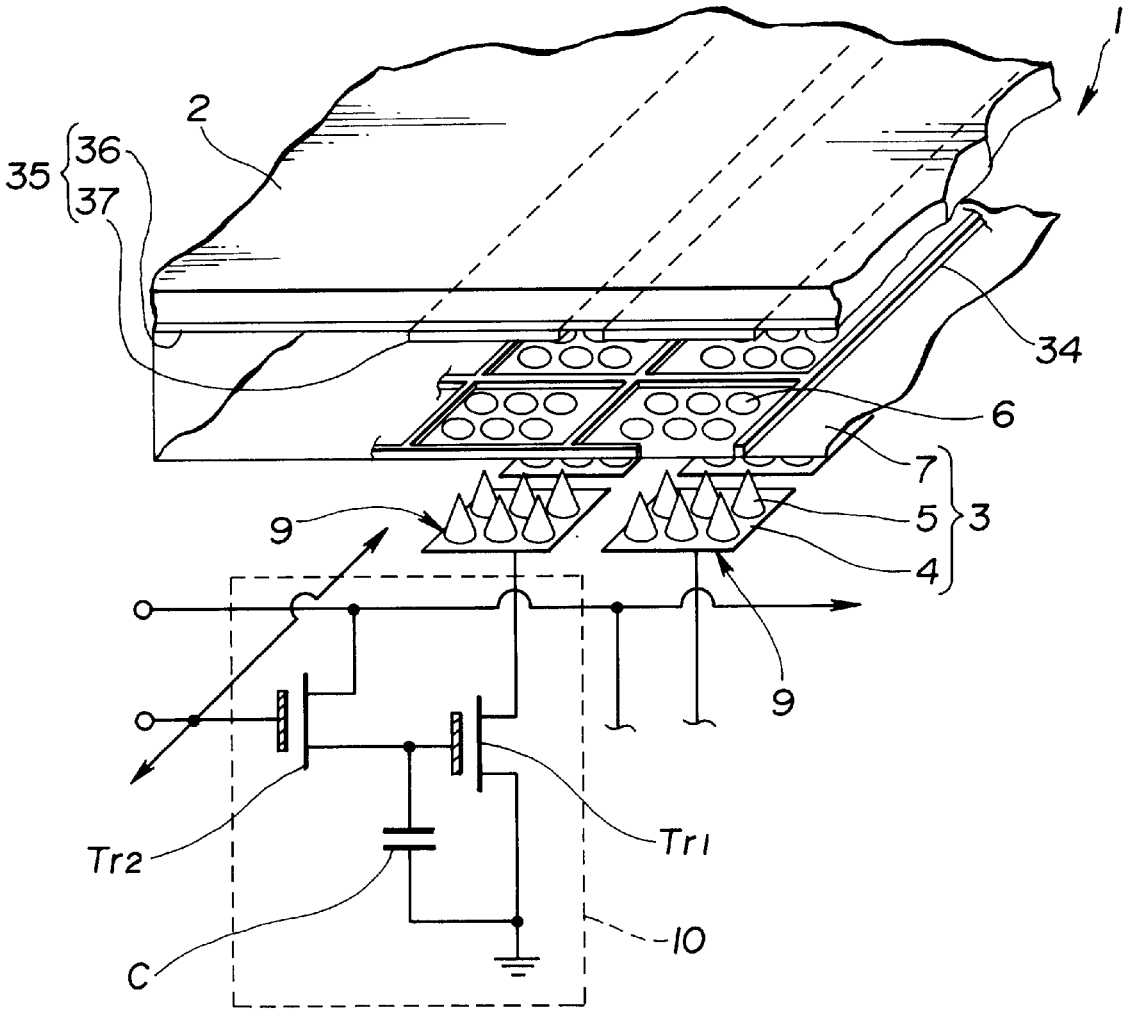
FIG. 14 is a fragmentary perspective view shoving a second embodiment of a field emission type fluorescent display device according to the present invention.
Figure 15:
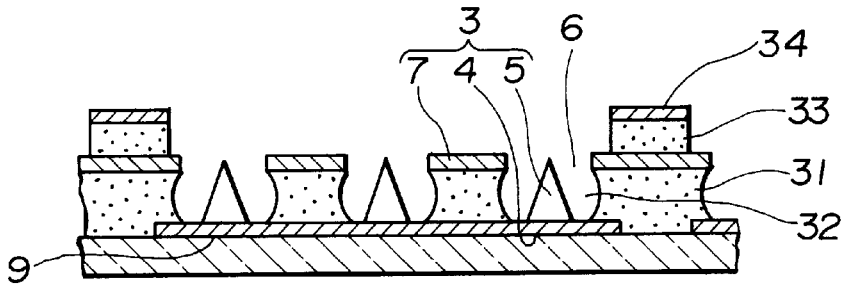
FIG. 15 is a vertical sectional view showing a structure on a side of a cathode substrate in the field emission type fluorescent display device of FIG. 14.
Figure 16:
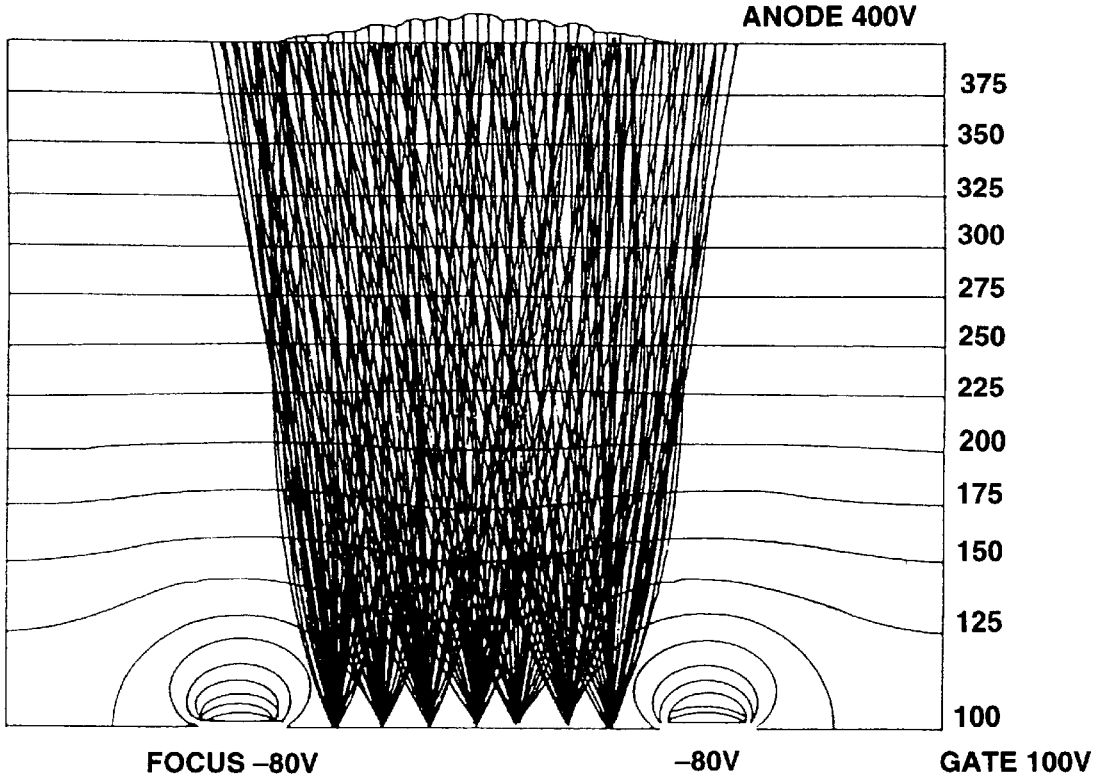
FIG. 16 is a view showing results of field analysis carried out on the field emission type fluorescent display device of FIG. 14.
Figure 17:
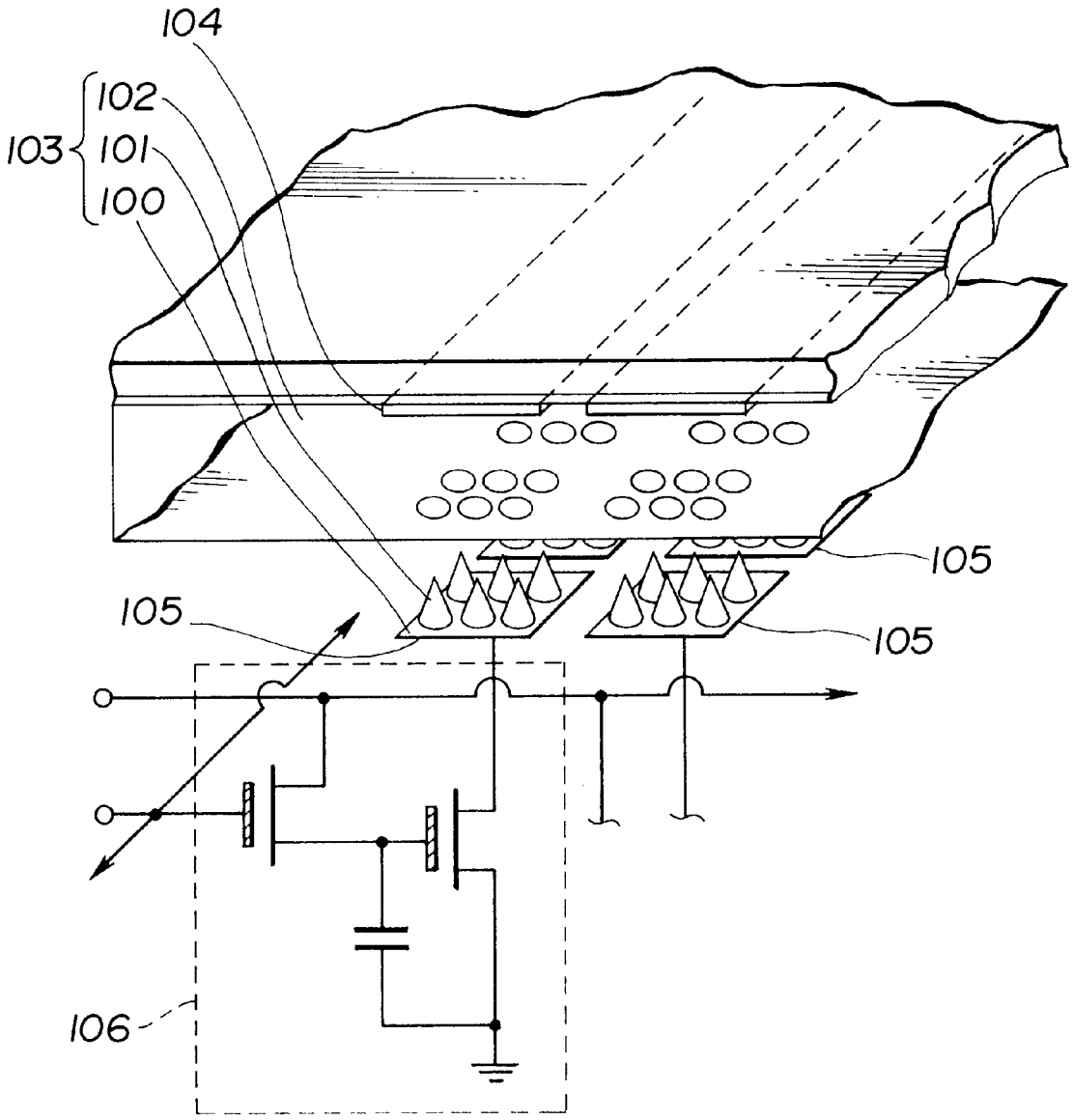
FIG. 17 is a fragmentary perspective view schematically showing a conventional field emission type fluorescent display device.
Figure 18:
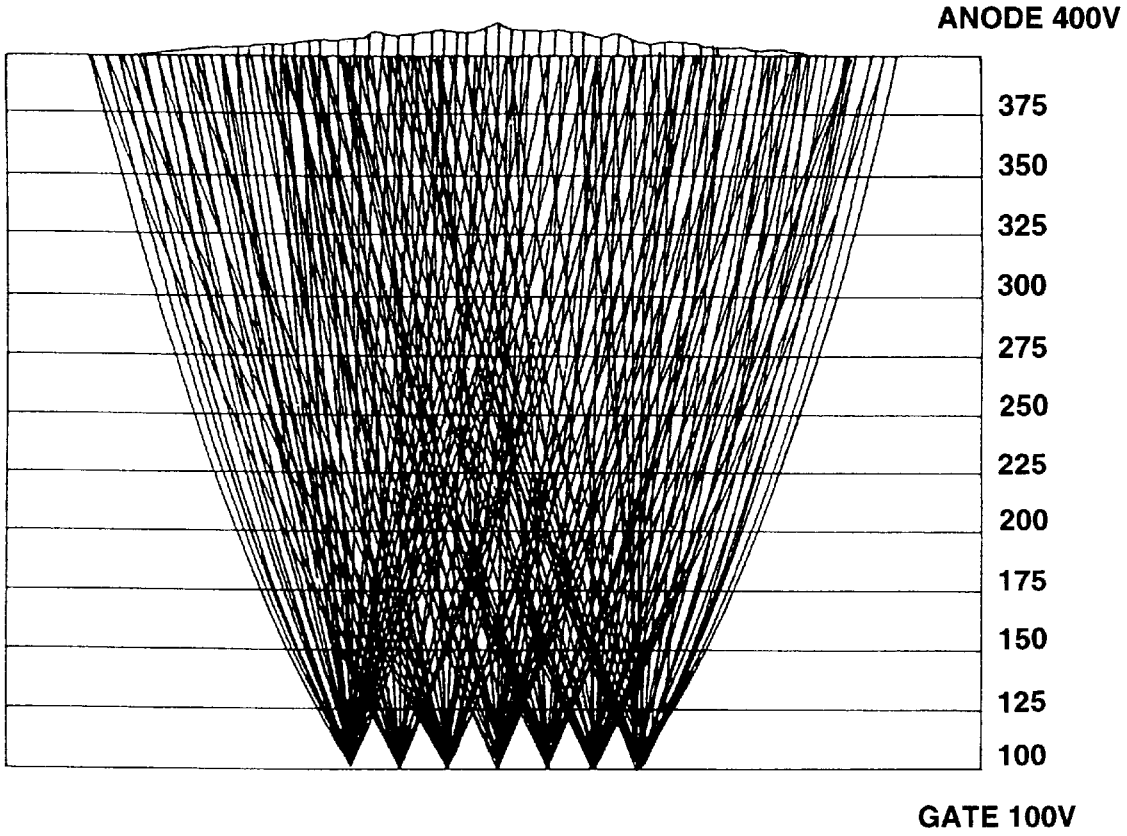
FIG. 18 is a view showing results of field analysis carried out on the conventional field emission type fluorescent display device of FIG. 17.

Referring now to FIGS. 14 to 16, a second embodiment of a field emission type fluorescent display device according to the present invention is illustrated. A field emission type fluorescent display device of the second embodiment which is generally designate at reference numeral 1, as shown in FIG. 14, includes a light-permeable anode substrate 2 and a cathode substrate (not shown) arranged in a manner to be spaced at a predetermined interval from the anode conductor 2 and opposite thereto, as in the first embodiment described above. Both substrates are sealedly Joined to each other through spacer members interposedly arranged therebetween to form an envelope, which is then evacuated to a high vacuum.

The cathode substrate, as shown in FIGS. 14 and 15, is formed on an inner surface thereof with a field emission cathode 3. The cathode 3 includes a cathode conductor 4, emitters 5 of a conical shape formed on the cathode 4 and a gate 7 arranged above the emitters 5 and formed with apertures 6 in a manner to positionally correspond to the emitters 5, as in the first embodiment described above.

Also, the field emission type fluorescent display device of the second embodiment includes a first insulating layer 31 formed of $SiO_2$ or the like and arranged on the cathode conductor 4. The first insulating layer 31 is formed with holes 32. The emitters 5 described above are formed of high-melting metal such as Mo or the like on portions of the cathode conductor 4 positioned in the holes 32 by vapor deposition.

The device of the second embodiment may further include a resistive layer arranged between the cathode conductor 4 and the emitters 5, for example, in the same patter as the cathode 4. The resistive layer may be made of a suitable material such as, for example, amorphous silicon, $SnO_2$, $In_2O_3$, $Fe_2O_3$, ZnO or the like. The resistive layer preferably exhibits a resistance value of, for example, $10^1$ to $10^6$ Ωcm.

In the field emission cathode 3, as shown in FIG. 14, the cathode conductor 4 is divided into a plurality of unit regions 9 each including a plurality of emitters 5. The unit regions 9 are juxtaposed with each other in both row and column directions perpendicular to each other, resulting in defining a matrix.

The unit regions 9 each include one driving transistor section 10, which includes two transistors Tr1 and Tr2 and a capacitor C. The unit regions 9 of the cathode conductor 4 each are connected to one of electrodes (a drain electrode or a source electrode) of one transistor Tr1 of each of the driving transistor sections 10, each of which is integrally incorporated together with the field emission cathode 3 onto the cathode substrate.

The transistors Tr2 of the driving transistor sections 10 arranged in a matrix-like manner are connected at a gate electrode thereof to each other for every column of the matrix and at a drain electrode thereof to each other for every row thereof.

In the matrix construction of the second embodiment, the rows are subject to main scanning and the columns are subject to subscanning in time with selection of each of the rows, so that image data are charged in the capacitor C of the driving transistor section 10 selected by scanning.

The anode substrate 2, as shown in FIG. 14, is formed on an inner surface thereof with an anode 35 acting as a luminous display section. The anode 35 includes three kinds of strip-like electrodes having phosphors of three colors R, G and B provided thereon and includes a light-permeable anode conductor 36 and phosphor layers 37 deposited on the anode conductor 36. Light emitted from the phosphor layers 37 can be externally observed through the light-permeable anode conductor 36 and anode substrate 2.

An electron discharge or emission section of the field emission cathode 3 is divided into a plurality of unit regions 9, which are matrix-driven by the corresponding driving transistor sections 10, respectively. Also, in the anode 35, luminous regions corresponding to the unit regions 9 each are selectively driven so as to act as a luminous dot of one unit, resulting in a desired graphic display being carried out.

In the second embodiment, the gate 7 of the field emission cathode 3, as shown in FIGS. 14 and 15, is provided on an upper surface thereof through a second insulating layer 33 with a focusing electrode 34, which is formed into a lattice-like configuration so as to surround the unit regions 9 arranged in a matrix-like configuration. The focusing electrode 34 structurally and electrically integrated with the unit regions 9 and has a negative voltage of a predetermined level applied thereto during driving of the field emission type fluorescent display device 1.

The remaining part of the second embodiment may be constructed in substantially the same manner as the first embodiment described above.

Now, the manner of operation of the field emission type fluorescent display device of the second embodiment thus constructed will be described hereinafter.

Driving of the device 1 is carried out through main scanning in the row direction and subscanning in the column direction by means of the cathode driving circuit.

In the second embodiment constructed as described above, the main scanning and subscanning are carried out in the row and column directions by means of the cathode driving circuit, respectively, so that the field emission type fluorescent display device 1 is driven. This results in transfer of the image data being carried out for every row because the column direction is fully scanned for every scanning of one row. Such operation is repeated from a first row to a last row in turn, so that display data are transferred to all the driving transistor sections 10 including the capacitor C acting as a storage means. Then, the anode 35 is driven to carry out a display for one image plane while the main scanning on a side of the cathode is carried out.

During the driving, electrons are emitted from the unit regions 9 of the field emission cathode 3 selected. Then, the electrons are converged or focused by the focusing electrode 34, resulting in impinging on the anode 35 without diffusing. This permits only the luminous regions of the anode 35 selected to emit light, so that leakage luminescence is prevented.

FIG. 16 shows results of computer simulation of field analysis carried out for measuring a distribution of electrons during operation of the fluorescent display device of the second embodiment. In the analysis, a potential of −80 V is applied to the focusing electrode 34 surrounding the unit regions 9 of the field emission cathode 3. FIG. 16 indicates that the focusing electrode 34 satisfactorily exhibits a function of substantially focusing electrons. Thus, luminous regions of the anode adjacent to the selected luminous regions thereof are kept non-luminous, resulting in leakage luminescence being fully prevented.

In the second embodiment, matrix driving of the field emission cathode 3 is carried out by subjecting the unit regions 9 of the cathode conductor 4 to switching control by means of the driving transistor section 10. Alternatively, the second embodiment may be so constructed that the gate 7 is divided into a plurality of unit regions, which are then subject to matrix driving using a switching means such as a driving transistor or the like.

Thus, it will be noted that the field emission type fluorescent display device of the second embodiment minimizes diffusion or spreading of electrons emitted from the unit regions of the cathodes to thereby accomplish a distinct display with high definition by means of picture cells increased in number. Thus, the second embodiment permits high luminance under a low voltage which is a feature of the field emission type fluorescent display device wherein the unit regions constituting electron emission section of the field emission cathode are subject to matrix driving to be exhibited to a maximum degree while minimizing leakage luminescence and color mixing, to thereby improve display quality.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. A field emission type fluorescent display device comprising:

a field emission cathode including a cathode conductor, emitters and a gate; and a phosphor-deposited anode arranged in a manner to be opposite to said field emission cathode;

said field-emission cathode having an electron emission region divided into a plurality of unit regions arranged in a matrix-like configuration;

said unit regions being subject to matrix driving resulting in a display being selectively carried out; and a focusing electrode arranged between said gate and said anode for surrounding said unit regions;

wherein said focusing electrode is fed with a voltage lower than that fed to said gate.

2. A field emission type fluorescent display device as defined in claim 1, wherein said focusing electrode is integrally formed.

* * * * *